US008967014B2

(12) United States Patent
Schulein et al.

(10) Patent No.: US 8,967,014 B2
(45) Date of Patent: Mar. 3, 2015

(54) MULTIPLE-AXIS MANUAL CONTROL DEVICE

(75) Inventors: Gerhard Schulein, Leingarten (DE); Alwin Ehrensperger, Heilbronn (DE)

(73) Assignee: W. Gessmann GmbH, Leingarten (DE)

( * ) Notice: Subject to any disclaimer, the term of this patent is extended or adjusted under 35 U.S.C. 154(b) by 303 days.

(21) Appl. No.: 13/329,564

(22) Filed: Dec. 19, 2011

(65) Prior Publication Data

US 2012/0152719 A1 Jun. 21, 2012

(30) Foreign Application Priority Data

Dec. 21, 2010 (DE) ..... 10 2010 063 746

(51) Int. Cl.
*G05G 9/047* (2006.01)
*G05G 5/05* (2006.01)

(52) U.S. Cl.
CPC . *G05G 9/047* (2013.01); *G05G 5/05* (2013.01)
USPC ..... 74/471 XY

(58) Field of Classification Search
CPC ..... G05G 9/047; G05G 2009/04766; G05G 2009/04718; G05G 1/04; G05G 2009/04703; G05G 2009/04714; B64C 13/04; E02F 9/2004; H01H 25/04; H01H 25/06; H01H 25/008; H01H 25/041; H01H 25/065; H01H 2025/043; H01H 2025/048
USPC ..... 74/469, 471 XY; 180/315, 332, 333; 200/4, 6 A, 6 R, 17 R, 18, 332, 335
See application file for complete search history.

(56) References Cited

U.S. PATENT DOCUMENTS

| | | | | |
|---|---|---|---|---|
| 3,771,037 | A | 11/1973 | Bailey, Jr. | |
| 4,555,960 | A * | 12/1985 | King | 74/471 XY |
| 5,140,313 | A * | 8/1992 | Wen | 345/161 |
| 5,597,261 | A | 1/1997 | Hayashi | |
| 5,629,505 | A * | 5/1997 | Cryer | 200/61.54 |
| 5,767,840 | A | 6/1998 | Selker | |
| 5,780,794 | A * | 7/1998 | Uchiyama et al. | 200/61.54 |
| 5,801,346 | A * | 9/1998 | Taniuchi | 200/11 K |
| 6,403,898 | B2 * | 6/2002 | Janniere et al. | 200/6 A |
| 6,462,731 | B1 * | 10/2002 | Stoffers et al. | 345/161 |
| 6,667,734 | B2 * | 12/2003 | Furukawa et al. | 345/161 |
| 7,544,905 | B2 * | 6/2009 | Downer | 200/6 A |

(Continued)

FOREIGN PATENT DOCUMENTS

| | | |
|---|---|---|
| CN | 1825241 A | 8/2006 |
| DE | 197 36 086 A1 | 11/1998 |

(Continued)

*Primary Examiner* — Justin Krause
(74) *Attorney, Agent, or Firm* — Hackler Daghighian & Martino

(57) ABSTRACT

A manual control device includes an actuation member which is supported on a switching rod for pivoting about at least one actuation member pivot axis which extends perpendicularly to the longitudinal axis of the switching rod. Furthermore, the switching rod is movably supported relative to a base member of the manual control device about or along a plurality of switching rod movement axes, there being provided restoring means, by means of which the actuation member which has been redirected out of a rest position about the actuation member pivot axis can be restored to the rest position. The restoring means have at least two resilient elements which are active counter to redirection of the actuation member from the rest position about the actuation member pivot axis and which are arranged radially opposite each other relative to the longitudinal axis of the switching rod.

9 Claims, 4 Drawing Sheets

(56) References Cited

U.S. PATENT DOCUMENTS

| | | | | |
|---|---|---|---|---|
| 7,601,924 | B2 * | 10/2009 | Demirtas et al. | 200/6 A |
| 7,628,173 | B2 * | 12/2009 | Rosko et al. | 137/625.4 |
| 7,671,284 | B2 * | 3/2010 | Nourry et al. | 200/5 A |
| 7,712,485 | B2 * | 5/2010 | Kitten et al. | 137/636 |
| 2002/0003082 | A1 | 1/2002 | Janniere et al. | |
| 2012/0152719 | A1 * | 6/2012 | Schulein et al. | 200/6 R |

FOREIGN PATENT DOCUMENTS

| | | | |
|---|---|---|---|
| DE | 19736086 | * | 11/1998 |
| EP | 1 898 126 A2 | | 3/2008 |

* cited by examiner

MULTIPLE-AXIS MANUAL CONTROL DEVICE

The invention relates to a manual control device which has an actuation member which is supported on a switching rod for pivoting about at least one actuation member pivot axis which extends perpendicularly to the longitudinal axis of the switching rod, the switching rod being movably supported relative to a base member of the manual control device about or along a plurality of switching rod movement axes, and there being provided restoring means, by means of which the actuation member which has been redirected out of a rest position about the actuation member pivot axis can be restored to the rest position.

Such manual control devices are used, for example, for controlling handling installations, cranes, vehicles, aircraft, etcetera. They are sometimes also referred to as composite drives and may be constructed as control sticks or joysticks. The actuation member of the manual control device, for example, an actuation cap, a handle, etc. is supported for movement about a plurality of movement axes relative to a base member of the manual control devices. An actuation of the actuation member about one of the movement axes brings about, for example, control of the object to be handled about an object-related movement axis which is associated with the actuated movement axis. In other applications, various control elements, for example, elevators or ailerons etc. of an aircraft may be associated with the individual movement axes.

A manual control device of the generic type is known from U.S. Pat. No. 4,555,960. The manual control device described therein is constructed as a 6-axis control stick for an aircraft. An actuation cap of the control stick can be moved relative to a base member about or along six different movement axes. In particular, the actuation member is supported at one end of a switching rod for pivoting about two actuation member pivot axes and the switching rod itself is supported on the base member for pivoting about two further switching rod pivot axes. Owing to the spatial separation of the bearing for the actuation member pivot axes and for the switching rod pivot axes, they can be readily actuated independently of each other by an operator.

In the case of the prior art according to U.S. Pat. No. 4,555,960, in particular the actuation member pivot axes are each provided with a restoring unit which in each case restores the actuation member which is redirected from a rest position into the rest position under the action of a spring. In detail, the restoring units are formed by a drive pin, two redirection arms which are rotatably arranged relative to each other and a resilient element which is tensioned between the redirection arms. The drive pin is securely connected to a pivot shaft of the associated actuation member pivot axis. A redirection of the pivot shaft from the rest position brings about via the drive pin a redirection of one of the redirection arms with the resilient element which is arranged therebetween being pulled apart. The resilient element tensioned in this manner brings about a restoring force for the actuation member. The restoring means of the control stick according to U.S. Pat. No. 4,555,960 are relatively costly and subject to malfunction.

Based on the prior art, an object of the invention is to provide a manual control device which has robust and, at the same time, compact restoring means for at least one actuation member pivot axis.

SUMMARY OF THE INVENTION

The object is achieved according to the invention by the restoring means having at least two resilient elements which are active counter to redirection of the actuation member from the rest position or idle position about the actuation member pivot axis and which are arranged radially opposite each other relative to the longitudinal axis of the switching rod.

Owing to the symmetrical arrangement of the resilient elements with respect to the longitudinal axis of the switching rod, there is a favourable or symmetrical introduction of force with respect to the longitudinal axis of the switching rod. Owing to the fact that two resilient elements are used, it is unnecessary to use a mechanism which is subject to malfunction and which allows a restoring force to be produced in the event of a redirection of the actuation member in both pivot directions from the rest position.

Advantageous further developments of the invention according to the independent claim will be appreciated from the dependent claims.

In the case of a particularly preferred embodiment of the invention, a resilient element serves to restore the actuation member in the event of a redirection of the actuation member about the associated actuation member pivot axis in one pivot direction and the other resilient element in the opposite pivot direction. In this manner, it is possible to use structurally simple resilient elements which must act in only one actuation direction.

A particularly play-free arrangement of the resilient elements is achieved with a preferred configuration of the invention in which the resilient elements have mutually compensating pretensioning at least in the rest position of the actuation member.

The restoring means are preferably constructed in such a manner that a first resilient element can be deformed by redirection of the actuation member about the actuation pivot axis in one pivot direction, the second resilient element being prevented from becoming deformed by means of an end stop. Furthermore, the second resilient element can be deformed by redirection of the actuation member about the actuation member pivot axis in the opposite pivot direction, the first resilient element being prevented from becoming deformed by means of an end stop. Owing to the end stops for the resilient elements which are active when leaving the rest position, the actuation member can be pretensioned in a play-free manner in the rest position by means of the resilient elements but the restoring forces may be produced in each case by only one resilient element, without the other resilient element bringing about a partially compensating resilient force. There are produced restoring means which are highly effective even with the smallest redirections of the actuation member.

A configuration of the resilient elements as axial resilient elements, in particular as compression and/or as resilient elements has been found to be advantageous in practice. A variant of the invention in which the resilient elements are constructed as helical compression springs is distinguished as particularly simple and cost effective.

Particularly favourable conditions are produced when the clamping axes or resilient axes of the resilient elements extend parallel with the longitudinal axis of the switching rod and consequently perpendicularly relative to the actuation member pivot axis associated therewith. In this instance, it should be taken into consideration that a redirection of the actuation member about the actuation member pivot axis starting from the rest position through an angle of up to 20° is sufficient to carry out conventional control measures. In this angular range, a redirection of the actuation member about the actuation member pivot axis which extends perpendicularly relative to the longitudinal axis of the switching rod primarily brings about a displacement of the abutment faces for the resilient elements along the longitudinal axis of the switching rod. It is therefore particularly advantageous when the clamping axes of the resilient elements extend parallel with the longitudinal axis of the switching rod and the resilient elements can thereby absorb a main component of the displacement of the abutment faces for the resilient elements along their clamping axes.

The advantages of the restoring means constructed according to the invention set out above and described below are obtained in particular when two actuation member pivot axes are provided and there are associated with both actuation member pivot axes two resilient elements which are each arranged in pairs radially opposite each other relative to the longitudinal axis of the switching rod. A symmetrical and robust arrangement of the restoring means is produced on the whole.

In the case of a particularly preferred embodiment of the invention, all the actuation member movement axes and switching rod movement axes are each provided with separate restoring means. The restoring forces which can be produced by the restoring means are preferably adapted to each other in such a manner that the risk of unintentionally actuating one movement axis when actuating another is reduced. To this end, the restoring forces which can be felt by the operator on the actuation member are at least partially of different magnitudes, for example, the restoring forces for the actuation member pivot axes are noticeably smaller than those for the switching rod pivot axes. In particular, the restoring forces which are produced when an actuation member is pivoted about an actuation member pivot axis are significantly smaller than the restoring forces which are produced when the actuation member is redirected about a switching rod pivot axis which is parallel at least in the rest position of the actuation member.

A particularly symmetrical introduction of forces, and consequently a particularly robust construction distinguishes one embodiment of the invention in which the resilient elements which are associated with the actuation member pivot axes are supported at one end on one and the same component. In a particularly preferred configuration, this component is formed by a bearing ring, at whose opposing end faces a pair of the resilient elements is in abutment in each case.

The switching rod is preferably supported on the base member for rotation about a switching rod rotation axis which coincides with the longitudinal axis of the switching rod. The switching rod rotation axis is advantageously provided with restoring means, which are active counter to redirection about the switching rod rotation axis from a rest position. A particularly compact construction of the manual control device is achieved by the restoring means, which are associated with the rotation axis, and the resilient elements, which are associated with one of the actuation member pivot axes, at least partially overlapping with each other along the longitudinal axis of the switching rod.

BRIEF DESCRIPTION OF THE DRAWINGS

An embodiment of the invention is explained below with reference to schematic drawings illustrated in the Figures, in which.

DETAILED DESCRIPTION

Figure 1:
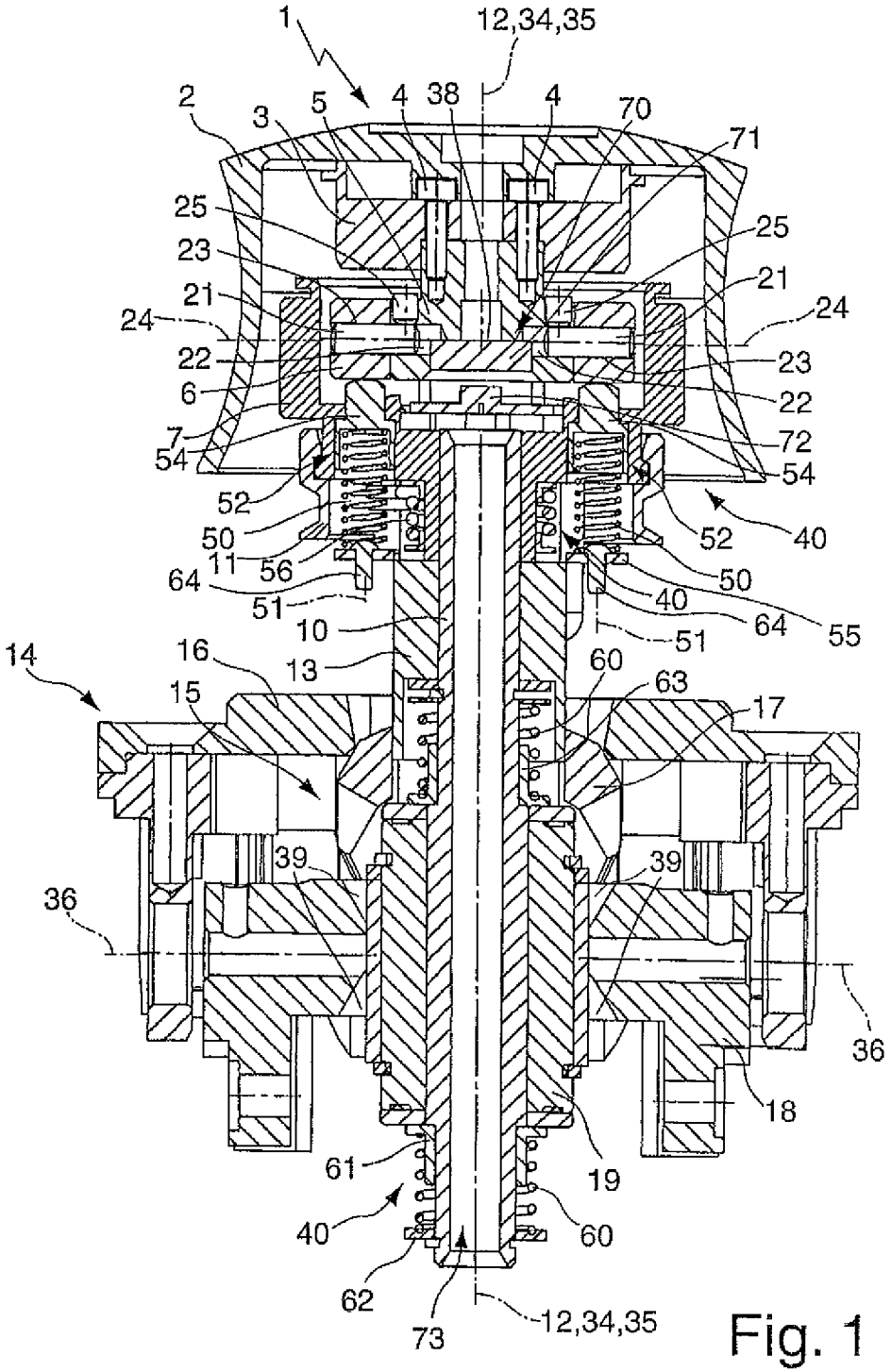
FIG. 1 is a sectioned illustration of a manual control device along a plane of section which extends parallel with the longitudinal axis of the switching rod.

FIG. 1 is a sectioned illustration of a manual control device 1. The manual control device 1, also referred to as a composite drive, serves to control, for example, handling installations, cranes, vehicles, aircraft, etcetera. The manual control device 1 is provided with an actuation member 2 which is constructed as an actuation cap. The actuation member 2 is placed on a fixing plate 3 and secured at that location by means of a screw which is not illustrated. The fixing plate 3 is itself securely connected to an actuation member articulation piece 5 by means of screws 4. The actuation member articulation piece 5 is surrounded by a bearing ring 6, which itself is arranged in an actuation member receiving sleeve 7.

The actuation member receiving sleeve 7 is fitted at one end of a switching rod 10 in a rotationally secure and axially non-displaceable manner. A grub screw 8 (FIG. 2) serves to secure the actuation member receiving sleeve 7 to the switching rod 10. A centering sleeve 11 (not illustrated in FIG. 2) surrounds a lower, thinner portion of the actuation member receiving sleeve 7. The actuation member receiving sleeve 7 is followed along the longitudinal axis 12 of the switching rod 10 by a switching rod sliding piece 13, which partially surrounds the switching rod 10.

Furthermore, the manual control device 1 has a base member 14 and a switching rod bearing device 15 which is accommodated in the base member 14. The base member 14 is provided at the upper side thereof and at the side facing the actuation member 2 with an attachment flange 16. The switching rod bearing device 15 has a switching rod curved pivot member 17, an annular switching rod articulation piece 18 and a switching rod articulation sleeve 19.

The movement axes of the actuation member 2 with respect to the base member 14 are explained in detail below. The actuation member articulation piece 5 which is securely connected to the actuation member 2 by means of the fixing plate 3 is supported by means of two pivot bearing pins 21 which are arranged at one end in cylindrical recesses 22 on the actuation member articulation piece 5 and at the other end in cylindrical recesses 23 on the bearing ring 6 for pivoting about a first actuation member pivot axis 24 (FIG. 1). Grub screws 25 serve to fix the pivot bearing pins 21 in the cylindrical recesses 22 on the actuation member articulation piece 5. The first actuation member pivot axis 24 extends perpendicularly relative to the longitudinal axis 12 of the switching rod 10 and in the plane of projection of FIG. 1.

Figure 2:
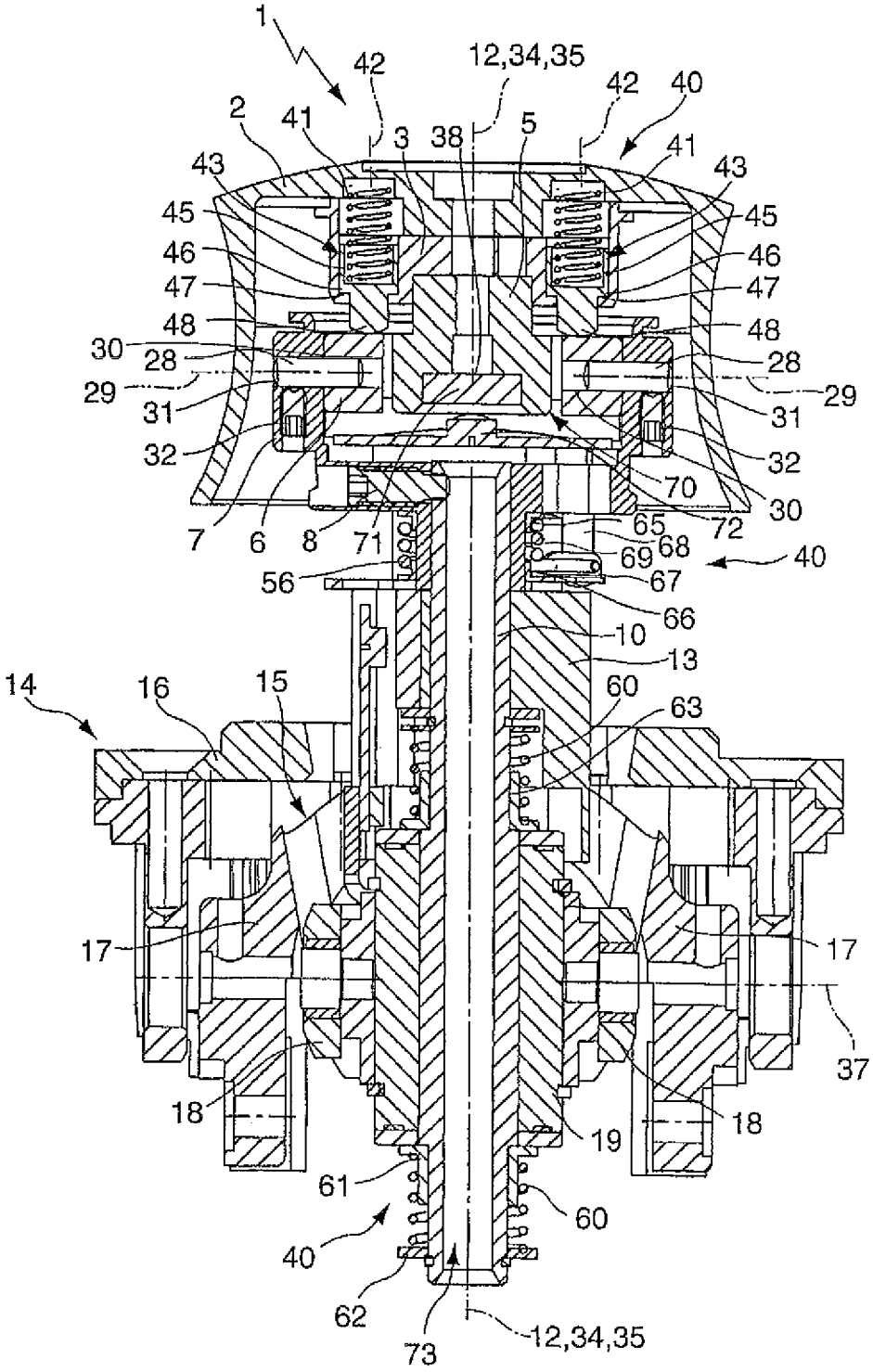
FIG. 2 is a second sectioned illustration of the manual control device along a plane of section which is rotated through 90° with respect to the plane of section according to FIG. 1.

From FIG. 2, which is a sectioned illustration of the manual control device 1 along a plane of section which is rotated through 90° with respect to the plane of section according to FIG. 1, it can be seen that the bearing ring 6 is supported on the actuation member receiving sleeve 7 by means of two pivot bearing pins 28 for pivoting about a second actuation member pivot axis 29. The pivot bearing pins 28 are arranged in cylindrical recesses 30 on the bearing ring 6 and in cylindrical recesses 31 on the actuation member receiving sleeve 7. Grub screws 32 serve to fix the pivot bearing pins 28 in the cylindrical recesses 31 on the actuation member receiving sleeve 7. The second actuation member pivot axis 29 also extends perpendicularly relative to the longitudinal axis 12 of the switching rod 10 and in the plane of projection of FIG. 2. The second actuation member pivot axis 29 is perpendicular relative to the first actuation member pivot axis 24.

The actuation member 2 can be pivoted in both pivot directions about an angle of up to a maximum of approximately 20° about the actuation member pivot axes 24, 29, starting from a rest position or idle position illustrated in FIGS. 1 and 2.

The actuation member 2 is further supported together with the switching rod 10 for movement about or along four different switching rod movement axes relative to the base member 14. The switching rod 10 is supported on the switching rod sliding piece 13 and on the switching rod articulation sleeve 19 for rotation about a switching rod rotation axis 34 which coincides with the longitudinal axis 12 of the switching rod 10. Furthermore, the switching rod 10 together with the actuation member 2 which is connected to the switching rod 10 by means of the actuation member receiving sleeve 7 in a rotationally secure and axially non-displaceable manner, is displaceably guided along the longitudinal axis 12 of the switching rod 10 on the switching rod sliding piece 13 and on the switching rod articulation sleeve 19 (switching rod translation axis 35).

Furthermore, the switching rod 10 including the switching rod articulation sleeve 19 is supported on the base member 14 by means of the switching rod articulation piece 18 for pivoting about a first switching rod pivot axis 36. The first switching rod pivot axis 36 extends in the plane of projection of FIG. 1. The switching rod articulation piece 18 is supported on the base member 14 by means of two screw-in pivot bearing pins (not illustrated) for pivoting about the first switching rod pivot axis 36.

In the rest position or idle position of the manual control device 1, the first switching rod pivot axis 36 extends perpendicularly relative to the longitudinal axis 12 of the switching rod 10. In this rest position, it also extends parallel with the first actuation member pivot axis 24.

Finally, the switching rod 10 is supported on the switching rod articulation piece 18 about a second switching rod pivot axis 37 which extends in the plane of projection of FIG. 2 and perpendicularly relative to the first switching rod pivot axis 36. In the rest position of the manual control device 1, it is further orientated parallel with the second actuation member pivot axis 29.

The pivot bearing which defines the second switching rod pivot axis 37 is formed by two pivot bearing pins (not illustrated) which can be screwed into corresponding recesses on the switching rod articulation piece 18 and on bearing extensions of the switching rod articulation sleeve 19 (FIG. 2).

When the switching rod 10 is pivoted about the second switching rod pivot axis 37, the switching rod curved pivot member 17 is carried. To this end, the switching rod curved pivot member 17 is supported on the base member for pivoting about the second switching rod pivot axis 37 by means of screw-in pivot bearing pins which are not illustrated.

Apertures 39 (merely indicated in FIG. 1) in the switching rod articulation piece 18 ensure undisturbed pivoting of the switching rod 10 including the pivot rod articulation sleeve 19 relative to the switching rod articulation piece 18 about the second switching rod pivot axis 37.

In total, the actuation member 2 can consequently be moved with respect to the base member 14 about the first and second actuation member pivot axis 24, 29, the switching rod rotation axis 34, the first and second switching rod pivot axes 36, 37 and along the switching rod translation axis 35. A 6-axis manual control device is consequently obtained overall.

The actuation member pivot axes 24, 29 and the switching rod rotation axis 34 intersect at a central engagement point 38 of the actuation member 2. From FIGS. 1 and 2, it can be seen that the components associated with the actuation member pivot axes 24, 29 are accommodated in a compact manner in the actuation member 2 which is constructed as an actuation cap.

In contrast, the first and second switching rod pivot axis 36, 37 intersect the switching rod 10 with a substantially larger spacing with respect to the central engagement point 38 of the actuation member 2 so that the actuation member 2 moves during a pivot movement about one of the switching rod pivot axes 36, 37 on a circular path with a relatively large radius. Although the spacing or pivot lever is different depending on the position of the actuation member 2 along the switching or translation axis 35, in all positions of the actuation member 2 along the switching rod translation axis 35 the spacing or pivot lever is significantly larger than that of the actuation member pivot axes 24, 29.

Consequently, the actuation member pivot axes 24, 29 and the switching rod pivot axes 36, 37 can be actuated independently of each other. Furthermore, the restoring forces of the restoring means described below are adapted to each other in such a manner that actuation, in particular of the actuation member pivot axes and the switching rod pivot axes 24, 29, 36, 37 independently of each other is readily possible by the restoring forces which are produced when the actuation member 2 is redirected about one of the actuation member pivot axes 24, 29 being noticeably smaller for the operator than those restoring forces which are produced when the actuation member 2 is redirected about one of the switching rod pivot axes 36, 37.

Restoring means 40 are associated with each of the movement axes 24, 29, 34 to 37. Using the restoring means 40, the actuation member 42 which has been redirected from a rest position with respect to the associated movement axes 24, 29, 34 to 37 can be restored to the rest position.

The restoring means 40 for the first actuation member pivot axis 24 have two resilient elements which are arranged radially opposite each other relative to the longitudinal axis 12 of the switching rod 10 and which are in the form of helical compression springs 41 (FIG. 2). The two helical compression springs 41 are radially spaced from the longitudinal axis 12 of the switching rod 10 by the same amount. Their clamping axes 42 or resilient axes extend parallel with the longitudinal axis 12 of the switching rod 10. At one end, the helical compression springs 41 are supported on the actuation member 2 and, at the other end, the helical compression springs 41 are supported on the upper end face of the bearing ring 6 by means of abutment actuators 43.

The abutment actuators 43 are displaceably guided in cylindrical actuator receiving members 45 on the fixing plate 3. If the actuation member 2 is arranged around the first actuating member pivot axis 24 in the rest position according to FIG. 2, radial projections 46 of the abutment actuators 43 abut abutment faces 47 in the actuator receiving members 45. At the same time, pressure heads 48 of the abutment actuators 43 act on the upper end face of the bearing ring 6 with a biasing force of the helical compression springs 41, whereby the actuation member 2 is held in the rest position without any play.

If the actuation member 2 moves in the clockwise direction, for example, in the event of a pivot movement brought about by an operator about the first actuation member pivot axis 24 in FIG. 2, the helical compression spring 41 on the right in FIG. 2 becomes compressed. However, the left-hand helical compression spring 41 remains unchanged because the abutment actuator 43 of the left-hand helical compression spring 41 abuts the abutment faces 47 of the actuator receiving member 45 with the radial projection 46 thereof. Movement of the abutment actuator 43 directed downwards in FIG. 2 is prevented. Consequently, the actuator receiving member 45 forms an end stop for the abutment actuator 43 or for the left-hand helical compression spring 41, on which the abutment actuator 43 is arranged if the actuation member 42 is arranged in the rest position and which prevents decompression of the left-hand compression spring 41 from the rest position.

Owing to the end stop, the upper end face of the bearing ring 6 and the pressure head 48 of the left-hand abutment actuator 43 move away from each other during the pivot movement of the actuation member 2. As soon as the actuation member 2 consequently leaves the rest position, only the increasing resilient force of the right-hand helical compression spring 41 acts on the bearing ring 6 as a restoring force which is not reduced by an opposing resilient force of the left-hand helical compression spring 41 owing to the end stop for the left-hand helical compression spring 41.

The restoring force which increases owing to the compression of the right-hand helical compression spring 41 acts counter to the redirecting movement of the actuation member 2 and brings about, when the operator releases the actuation member 2, a restoring movement of the actuation member 2 into the rest position shown in FIG. 2. Similar conditions are produced in the case of pivot movement in a counter-clockwise direction in FIG. 2, in this instance only the left-hand helical compression spring 41 being active.

The restoring means 40 which are associated with the second actuation member pivot axis 29 are of similar construction to the above-described restoring means 40 of the first actuation member pivot axis 24. They also comprise two resilient elements in the form of helical compression springs 50 (FIG. 1). The helical compression springs 50 are also arranged radially opposite each other relative to the longitudinal axis 12 of the switching rod 10 and have the same radial spacing relative to the longitudinal axis 12 of the switching rod 10. The clamping axes 51 of the helical compression springs 50 extend perpendicularly relative to the second actuation member pivot axis 29 and parallel with the longitudinal axis 12 of the switching rod 10. The helical compression springs 50 are supported at one end on a curved member 55 and, at the other end, by means of abutment actuators 52 on the lower front end of the bearing ring 6.

Figure 3:
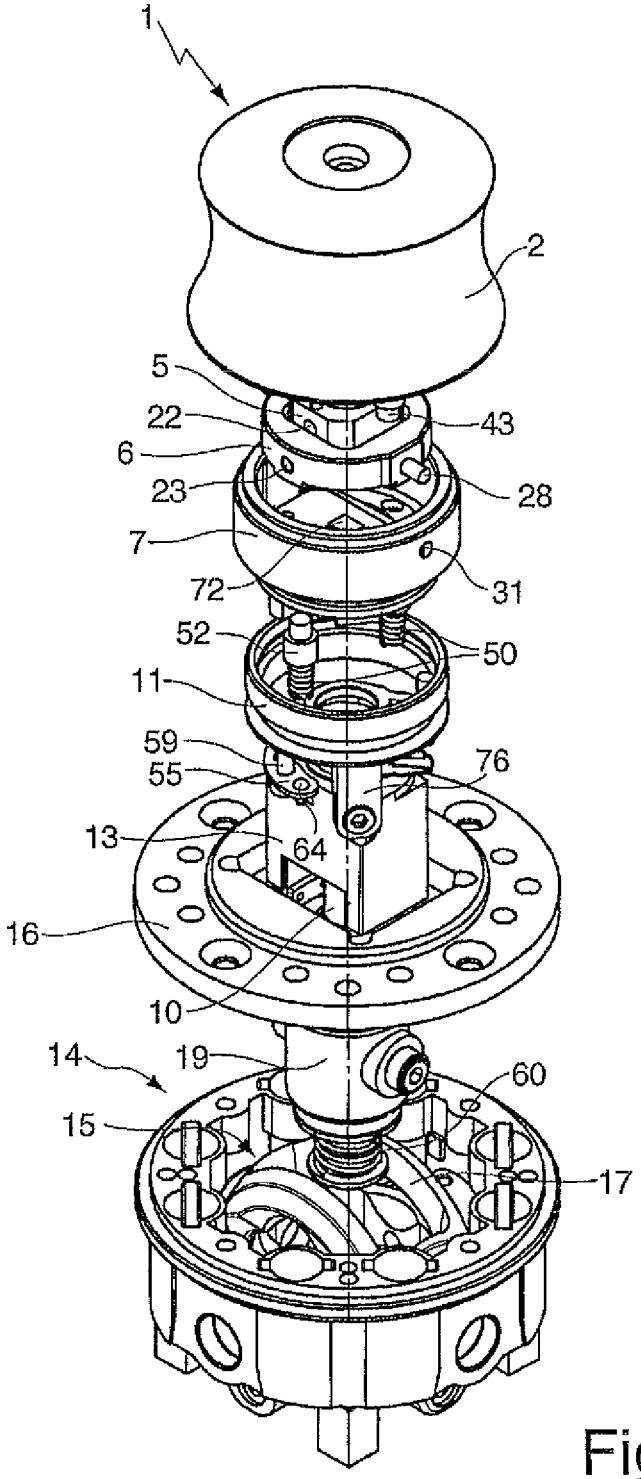
FIG. 3 is an exploded view of the manual control device.
Figure 4:
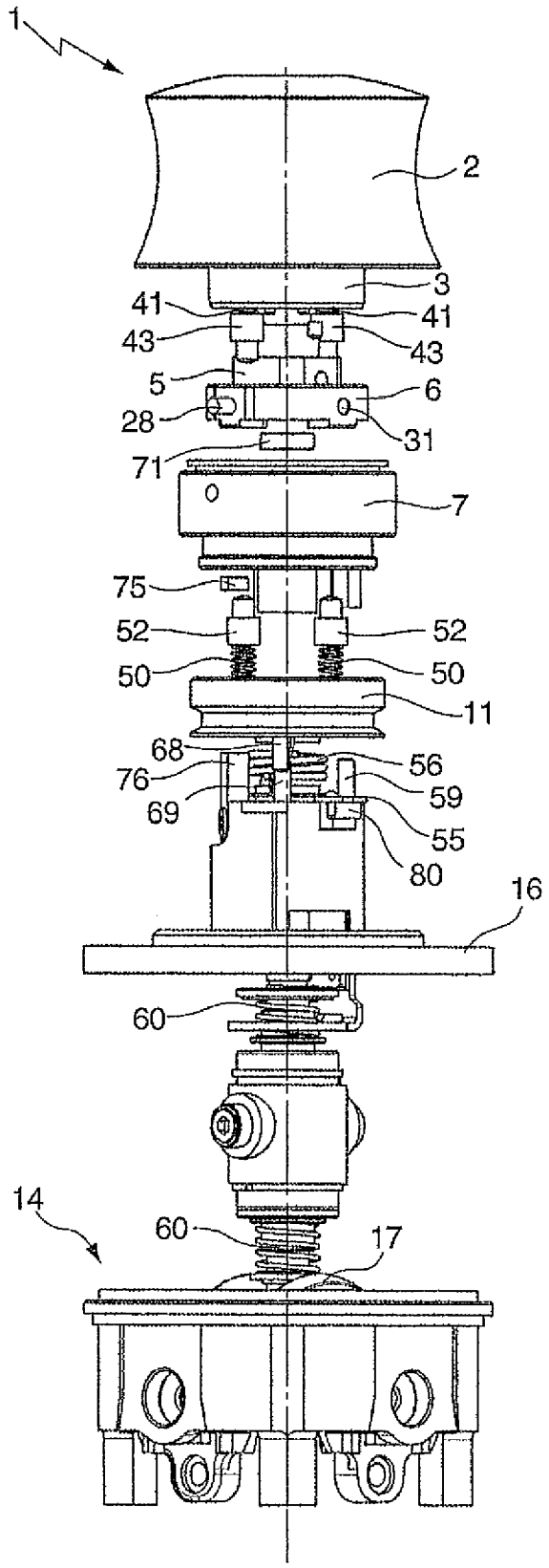
FIG. 4 is an exploded view of the manual control device from a different perspective to that in FIG. 3.

The curved member 55 is guided through approximately 190° around the lower portion of the actuation member receiving sleeve 7. The curved member 55 is securely connected to the upper portion of the actuation member receiving sleeve 7, which has a larger diameter than the lower portion, by means of two fixing rods 59 (FIGS. 3 and 4). The lower ends of the helical compression springs 50 are fixed to the curved member 55 by means of bolt rivets 64.

The abutment actuators 52 of the helical compression springs 50 are displaceably guided in actuator receiving members 54 on the actuation member receiving sleeve 7. Similarly to the actuator receiving members 45 on the fixing plate 3, the actuator receiving members 54 form end stops for the abutment actuators 52, which the abutment actuators 52 abut in the rest position of the actuation member 2.

The helical compression spring 50 on the left in FIG. 1 acts counter to redirection of the actuation member 2 about the second actuation member pivot axis 29 in a counter-clockwise direction according to FIG. 1. The helical compression spring 50 on the right in FIG. 1 acts counter to redirection of the actuation member in the clockwise direction according to FIG. 1. Under the conditions shown in FIG. 1, that is to say, in the rest position of the actuation member, the helical compression springs 50 are also provided with pretensioning. As soon as the actuation member 2 has left the rest position in relation to the second actuation member pivot axis 29, only one of the helical compression springs 50 is active owing to the end stops.

Since the helical compression springs 41 which are associated with the first actuation member pivot axis 24 are supported on the upper front end of the bearing ring 6 and the helical compression springs 50 which are associated with the second actuation member pivot axis 29 are supported on the lower front end of the bearing ring 6, the forces introduced owing to the pretensioning of the helical compression springs 41, 50 along the longitudinal axis 12 of the switching rod 10 advantageously cancel each other out.

The restoring means 40 associated with the switching rod rotation axis 34 have a leg spring 56 which surrounds the switching rod 10 and the lower (narrower) portion of the actuation member receiving sleeve 7 (FIG. 2). An upper sliding sleeve 65 and a lower sliding sleeve 66 are arranged between the leg spring 56 and the lower portion of the actuation member receiving sleeve 7.

It can be seen from FIG. 2 that the lower sliding sleeve 66 is provided with a radially projecting abutment lug 67. The upper sliding sleeve has a corresponding abutment lug (not shown). Two carrier pins 68 and 69 are further provided (FIGS. 2 and 4). The carrier pin 68 is securely connected to the actuation member receiving sleeve 7 and the carrier pin 69 is securely connected to the switching rod sliding piece 13.

The lower end of the leg spring 56 abuts the carrier pin 68 in a peripheral direction of the switching rod rotation axis 34 by means of the abutment lug 67 of the lower sliding sleeve 66 (FIG. 2), the upper end of the leg spring 56 abutting the carrier pin 69 in the opposite peripheral direction by means of the abutment lug (not shown) of the upper sliding sleeve 67.

When the actuation member 2 is redirected about the switching rod rotation axis 34 from the rest position shown, in accordance with the direction of rotation either the carrier pin 68 or the carrier pin 69 carries the associated end of the leg spring 56 in a direction of rotation, whereby the leg spring 56 becomes deformed and consequently a restoring force is produced. Compact and robust restoring means are produced for the switching rod rotation axis 34.

Furthermore, the maximum redirecting angle of rotation of the switching rod rotation axis 34 in both directions of rotation is limited by rotary stop means to approximately 5°. The heads 80 (FIG. 4) of the fixing screws for the fixing rods 59 act as rotary stop means. The heads 80 project into lateral notches on the switching rod sliding piece 13. They limit the rotation movement of the actuation member 32 about the switching rod rotation axis 34 in that they move into abutment with the switching rod sliding piece 13 at the maximum rotary position of the actuation member 2.

According to FIG. 1, the helical compression springs 50 which are associated with the second actuation member pivot axis 29 and the leg spring 56 overlap at least partially along the longitudinal axis 12 of the switching rod 10 so that a particularly compact manual control device 1 is produced.

The restoring means 40 of the switching rod translation axis 35 are formed by two helical compression springs 60 which are supported on the switching rod 10 and which are arranged at opposite sides of the switching rod articulation sleeve 19. A helical compression spring 60 is supported between the switching rod sliding piece 19 and an abutment sleeve 61 which abuts a radial projection of the switching rod 10. The other helical compression spring 60 is supported between an abutment ring 62 which is fixed to the switching rod 10 and an abutment sleeve 63 which abuts the switching rod articulation sleeve 19. The two helical compression springs are biased counter to each other in the rest position of the actuation member 2 or the switching rod 10 shown in FIGS. 1 and 2.

The restoring means of the first and second switching rod pivot axis 36, 37 are also constructed with resilient elements which are not shown and which are arranged between the switching rod articulation piece 18 and the base member 14 for the first switching rod pivot axis 36 and which are arranged between the switching rod curved pivot member 17 and the base member 14 for the second switching rod pivot axis 37.

FIGS. 3 and 4 are exploded illustrations of the manual control device 1 from two different viewing directions. From top to bottom, FIGS. 3 and 4 show the actuation member 2, the helical compression sprigs 41 including the abutment actuator 43, the actuation member articulation piece 5, the bearing ring 6, the actuation member receiving sleeve 7, the helical compression springs 50 including the abutment actuator 52 and the centering sleeve 11.

Furthermore, FIGS. 3 and 4 show the leg spring 56, the switching rod sliding piece 13, the attachment flange 16, the switching rod articulation sleeve 19, the base member 14 and the switching rod curved articulation member 17.

In order to detect the position of the actuation member 2 relative to the actuation member pivot axes 24, 29, a sensor unit 70 which is based on the Hall effect is provided. The sensor unit 70 has a permanent magnet 71 which is fixed to the lower side of the actuation member articulation piece 6 (FIG. 1). A 2D Hall sensor 72 is fixed to the actuation member receiving sleeve 7 opposite the permanent magnet 71. In the event of a pivot movement of the actuation member 2 about one of the actuation member pivot axes 24, 29, the permanent magnet 71 changes its position relative to the 2D Hall sensor 72 which subsequently produces a corresponding measurement signal. The 2D Hall sensor 72 is connected to an evaluation unit (not shown) via signal lines (not shown) which extend through an axial through-hole 73 of the switching rod 10. A particularly compact sensor unit 70 is produced for the actuation member pivot axes 24, 29.

In order to detect the rotary position of the actuation member 2 about the switching rod rotation axis 34, a sensor unit 74 based on the Hall effect is also provided. A permanent magnet 75 (FIG. 4) is provided on a fixing bar 76 which extends along the longitudinal axis 12 of the switching rod 10 and which is securely screwed to the switching rod sliding piece 13. A Hall effect sensor (not shown) which generates measurement signals in accordance with the relative position of the permanent magnet 75 and the Hall effect sensor is arranged at the lower side of the actuation member receiving sleeve 7 opposite the permanent magnet 75, which signals are supplied to an evaluation unit via signal lines which are not shown and which also extend through the axial through-hole 73 of the switching rod 10.

In order to detect the position of the actuation member 2 in relation to the remaining movement axes 35, 36, 37, sensor units based on the Hall effect, conventional electronic rotary sensors or the like are also provided.

It will be understood that the actuation member 2 may also have different forms. For example, the actuation member 2 may be constructed so as to be hemispherical. Furthermore, the manual control device may optionally be provided with a protective sleeve which surrounds in particular the switching rod 10, etc., in a protective manner between the actuation member 2 and the base member 14.

What is claimed is:

1. A manual control device comprising:

an actuation member supported on a switching rod for pivoting about at least one actuation member pivot axis comprising pivot bearing pins, the pivot axis extending perpendicularly to the longitudinal axis of the switching rod, the switching rod being movably supported relative to a base member of the manual control device about or along a plurality of switching rod movement axes, wherein the at least one actuation member pivot axis differs from the plurality of switching rod movement axes; and a restoring means, for restoring the actuation member, redirected out of a rest position about the at least one actuation member pivot axis, to the rest position, the restoring means having at least two resilient elements which are active counter to redirection of the actuation member from the rest position about the at least one actuation member pivot axis and arranged radially opposite each other relative to the longitudinal axis of the switching rod;

wherein the restoring means are constructed in order that a first resilient element can be deformed by redirection of the actuation member from the rest position about the actuation member pivot axis in one pivot direction, the second resilient element being prevented from becoming deformed by means of a first end stop, and the second resilient element can be deformed by redirection of the actuation member from the rest position about the actuation member pivot axis in an opposite pivot direction from the one pivot direction, the first resilient element being prevented from becoming deformed by means of a second end stop.

2. The manual control device according to claim 1, wherein one resilient element is active counter to redirection of the actuation member about the actuation member pivot axis in one pivot direction and another resilient element is active counter to redirection of the actuation member about the actuation member pivot axis in the opposite pivot direction.

3. The manual control device according to claim 1, wherein the resilient elements have mutually compensating pretensioning at least in the rest position of the actuation member.

4. The manual control device according to claim 1, wherein the resilient elements are in the form of axial resilient elements, compression and/or tensile resilient elements.

5. The manual control device according to claim 1, wherein the resilient elements are in the form of helical compression springs.

6. The manual control device according to claim 1, wherein the clamping axes of the resilient elements extend parallel with the longitudinal axis of the switching rod.

7. The manual control device according to claim 1, wherein the actuation member is supported for pivoting about at least a second actuation member pivot axis which extends to the longitudinal axis of the switching rod, and associated with the two actuation member pivot axes are two resilient elements, each arranged in pairs radially opposite each other relative to the longitudinal axis of the switching rod.

8. The manual control device according to claim 7, wherein the resilient elements associated with the actuation member pivot axes are supported at one end on one and the same component.

9. The manual control device according to claim 1, wherein the switching rod is rotatably supported relative to the base member about the longitudinal axis of the switching rod and the restoring means, active counter to rotary redirection movement of the switching rod about the longitudinal axis thereof, overlap at least partially along the longitudinal axis of the switching rod with the resilient elements associated with one of the actuation member pivot axes.

* * * * *